US008439633B2

(12) United States Patent
Mundra et al.

(10) Patent No.: US 8,439,633 B2
(45) Date of Patent: May 14, 2013

(54) HOLLOW STEAM GUIDE DIFFUSER HAVING INCREASED PRESSURE RECOVERY

(75) Inventors: Kamlesh Mundra, Clifton Park, NY (US); Prakash B. Dalsania, Karnataka (IN)

(73) Assignee: General Electric Company, Schenectady, NY (US)

( * ) Notice: Subject to any disclaimer, the term of this patent is extended or adjusted under 35 U.S.C. 154(b) by 665 days.

(21) Appl. No.: 12/651,611

(22) Filed: Jan. 4, 2010

(65) Prior Publication Data

US 2011/0164972 A1 Jul. 7, 2011

(51) Int. Cl.
*F01D 11/00* (2006.01)

(52) U.S. Cl.
USPC ..... 415/169.1; 415/178

(58) Field of Classification Search ..... 415/211.2, 415/169.1, 178
See application file for complete search history.

(56) References Cited

U.S. PATENT DOCUMENTS

| | | | | |
|---|---|---|---|---|
| 3,338,052 | A * | 8/1967 | Holden | 60/690 |
| 4,214,452 | A * | 7/1980 | Riollet et al. | 60/697 |
| 5,167,123 | A * | 12/1992 | Brandon | 60/690 |
| 5,209,634 | A | 5/1993 | Owczarek | |
| 5,588,799 | A | 12/1996 | Kreitmeier | |
| 6,261,055 | B1 | 7/2001 | Owczarek | |
| 6,419,448 | B1 * | 7/2002 | Owczarek | 415/207 |
| 6,447,247 | B1 | 9/2002 | Geiger | |
| 2009/0263241 | A1 * | 10/2009 | Demiraydin et al. | 415/207 |

* cited by examiner

*Primary Examiner* — Edward Look
*Assistant Examiner* — William Grigos
(74) *Attorney, Agent, or Firm* — Cantor Colburn LLP

(57) ABSTRACT

A steam turbine includes a diffuser that has a bearing cone and an inner plate of a steam guide that define a passage through which steam flows. An outer plate is disposed with respect to the inner plate such that an opening is located between the inner and outer plates. At least one hole is located in the inner plate. A water tube is disposed in the opening, the water tube having water flowing therethrough which condenses at least a portion of a flow of steam flowing in the passage thereby creating at least a partial vacuum within the opening. The vacuum creates a suction effect through the at least one hole in the inner plate that can cause at least a portion of the flow of steam in the passage to attach itself to an inner surface of the inner plate.

18 Claims, 2 Drawing Sheets

HOLLOW STEAM GUIDE DIFFUSER HAVING INCREASED PRESSURE RECOVERY

BACKGROUND OF THE INVENTION

The subject matter disclosed herein relates to steam turbines and, in particular, to a diffuser with a hollow opening steam guide having a vacuum located within the hollow opening to increase pressure recovery in the flow of steam adjacent the inner steam guide surface by reducing steam flow separation adjacent the inner steam guide surface.

The low pressure section of a steam turbine typically includes several turbine blade stages and a combination exhaust hood and diffuser section, including a down flow diffuser. Functions of the exhaust hood/diffuser include the recovery of (i.e., increasing) the static pressure as the velocity of the flow of steam decreases as it enters the diffuser. Also, the diffuser acts as a turbine steam exhaust flow passage that guides the flow of steam as it exits axially from the last stage blade of the turbine and directs it radially downstream towards a condenser within the steam turbine. Similarly, the diffuser directs the flow of steam downstream into the exhaust hood. Flow diffusion commonly takes place in the initial portion of the diffuser following the last stage blade. The remainder of the diffuser functions as a collecting or guiding chamber for the steam flowing to the condenser. The diffuser steam flow channel is typically bounded by a steam flow guide and a bearing cone.

The amount of pressure recovery within a diffuser typically depends on the inlet profile of the diffuser as well as the length of the diffuser and the area ratio (i.e., the diffuser outlet-to-inlet area ratio). For a given last stage blade exit profile, there may exist an area ratio that produces the relatively greatest pressure recovery in the diffuser. However, when the area ratio is made to be greater than that which produces the relatively greatest pressure recovery, the steam flow tends to separate from the steam guide after the flow enters the diffuser. Such flow separation decreases the amount of pressure recovery in the exhaust hood/diffuser. As a result, oftentimes the area ratio is made to be less than desirable (i.e., smaller) to ensure that the flow does not separate from the steam guide and adversely affect the diffusion of the steam flow.

BRIEF DESCRIPTION OF THE INVENTION

According to one aspect of the invention, a steam turbine includes a diffuser that has a bearing cone and an inner plate of a steam guide that define a passage through which steam flows. An outer plate is disposed with respect to the inner plate such that an opening is located between the inner and outer plates. At least one hole is located in the inner plate. A water tube is disposed in the opening, the water tube having water flowing therethrough which condenses at least a portion of a flow of steam flowing in the passage thereby creating at least a partial vacuum within the opening. The vacuum creates a suction effect through the at least one hole in the inner plate that can cause at least a portion of the flow of steam in the passage to attach itself to an inner surface of the inner plate.

According to another aspect of the invention, an axial diffuser for a steam turbine includes a bearing cone and an inner plate of a steam guide that define a passage through which steam flows downstream therethrough. The axial diffuser also includes an outer plate disposed with respect to the inner plate such that an opening is located between the inner and outer plates, and at least one hole is located in the inner plate. The axial diffuser further includes a water tube disposed in the opening, the water tube having water flowing therethrough which condenses at least a portion of a flow of steam flowing in the passage thereby creating at least a partial vacuum within the opening, the vacuum creating a suction effect through the at least one hole in the inner plate that can cause at least a portion of the flow of steam in the passage to attach itself to an inner surface of the inner plate.

According to yet another aspect of the invention, a diffuser section of a steam turbine includes a bearing cone and a steam guide having an inner plate, the bearing cone and the inner plate of the steam guide defining a passage through which steam flows. An outer plate is disposed with respect to the inner plate such that an opening is located between the inner and outer plates. At least one hole is located in the inner plate. A water tube is disposed in the opening, the water tube having water flowing therethrough which condenses at least a portion of a flow of steam flowing in the passage thereby creating at least a partial vacuum within the opening. The vacuum creates a suction effect through the at least one hole in the inner plate that can cause at least a portion of the flow of steam in the passage to attach itself to an inner surface of the inner plate.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
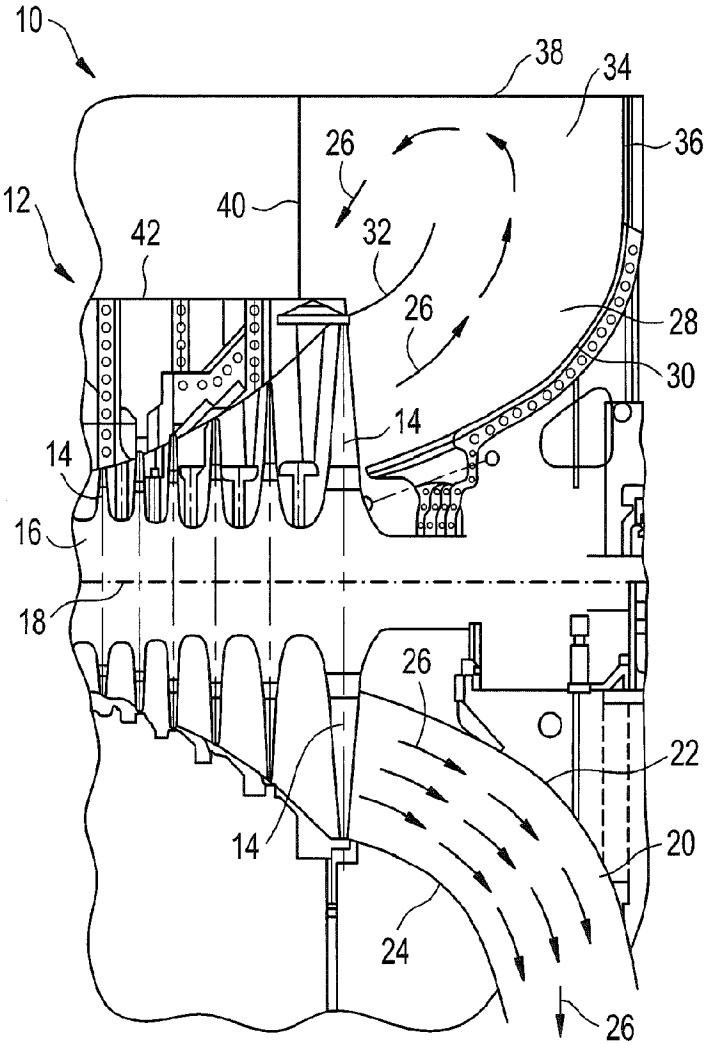
FIG. 1 is a cross section of a portion of a steam turbine showing the flow of steam through a diffuser section.

In FIG. 1 is a portion of a steam turbine 10; in particular, the low pressure turbine portion 12 of the steam turbine 10. The low pressure turbine portion 12 includes several turbine blade stages 14 that connect with a central shaft 16, which rotates about an axis 18. After the flow of steam exits the low pressure turbine portion 12, the flow of steam enters a down flow diffuser 20, which comprises an annular passage that is bounded by a bearing cone 22 and a steam guide 24. The steam flow in the diffuser 20 is indicated in FIG. 1 by lines with arrowheads 26. The steam flow 26 in the diffuser 20 may be directed from an axial direction along the axis 18 to a radial direction and flow downstream to a condenser (not shown). The flow of steam 26 exiting the low pressure turbine portion 12 also enters a down flow diffuser 28, which comprises an annular passage that is bounded by a bearing cone 30 and a steam guide 32. As the steam flow 26 flows downstream through the diffuser 28, it enters a downstream exhaust hood 34 on the turbine portion 12 in FIG. 1. The exhaust hood 34 is bounded by walls 36, 38. A plate 40 may be included that connects between the outer wall 38 of the exhaust hood 34 and a casing 42 of the low pressure turbine portion 12.

For a given last stage blade 14 exit profile, there may exist an area ratio of the diffuser 20, 28 (i.e., the ratio of the area of the diffuser outlet to the area of the diffuser inlet) that produces the relatively greatest pressure recovery in the exhaust hood 34 and the diffuser 20, 28. FIG. 1 shows such an area ratio. In particular, FIG. 1 shows that there is no separation of the steam flow 26 from an inner surface of the steam guide 24, 32 or from the bearing cone 22, 30.

Figure 2:
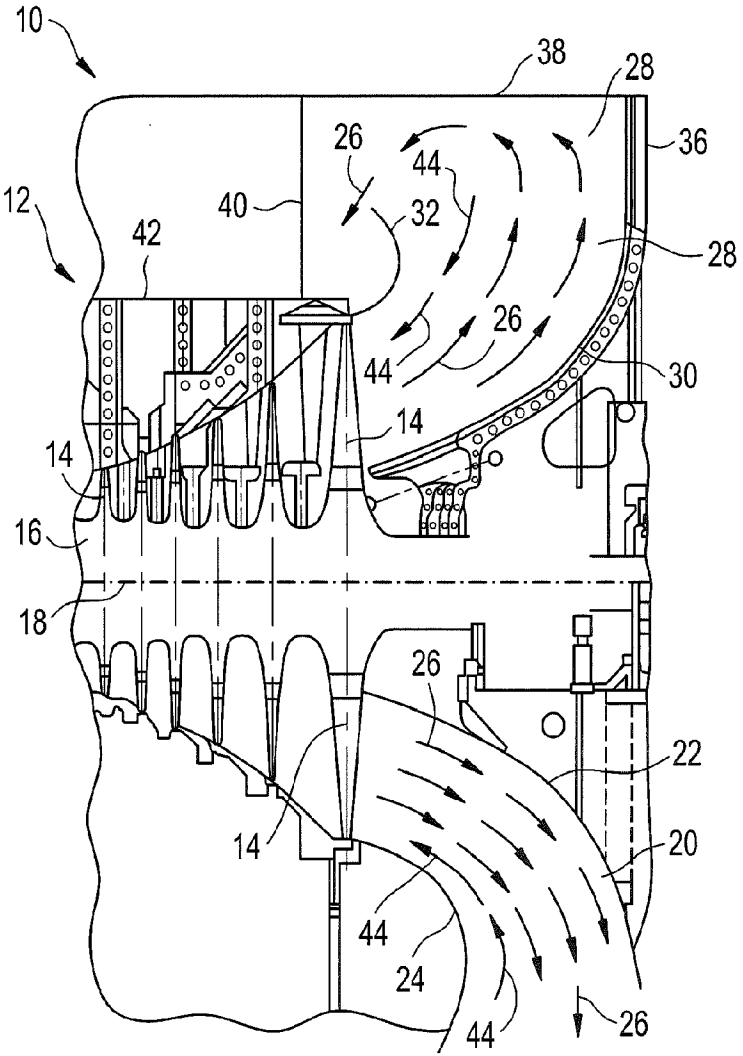
FIG. 2 is a cross section of the portion of the steam turbine of FIG. 1 showing the flow of steam through the diffuser section in which the steam flow separates from the steam guide.

However, when the area ratio is made to be greater than that which produces the relatively greatest pressure recovery (e.g., as in FIG. 1), the steam flow 26 tends to separate away from the inner surface of the steam guide 24, 32 after the flow of steam enters the diffuser 20, 28. The flow of steam may even reverse direction adjacent to the steam guide 24, 32 as indicated by the lines with arrowheads 44 in FIG. 2, which shows the identical low pressure portion 12 of the steam turbine 10 as in FIG. 1. The only difference between FIGS. 1 and 2 is that in FIG. 2 the steam guides 24, 32 curve more outward than in FIG. 1. As a result, the area ratio of the diffusers 20, 28 in FIG. 2 is greater than the area ratio of the corresponding diffusers 20, 28 in FIG. 1. Such separation of the steam flow 26, 44 tends to decrease the amount of pressure recovery in the exhaust hood 34 and the diffuser 20, 28 as little or no diffusion takes place in the diffuser 20, 28 during such a flow separation condition.

Figure 3:
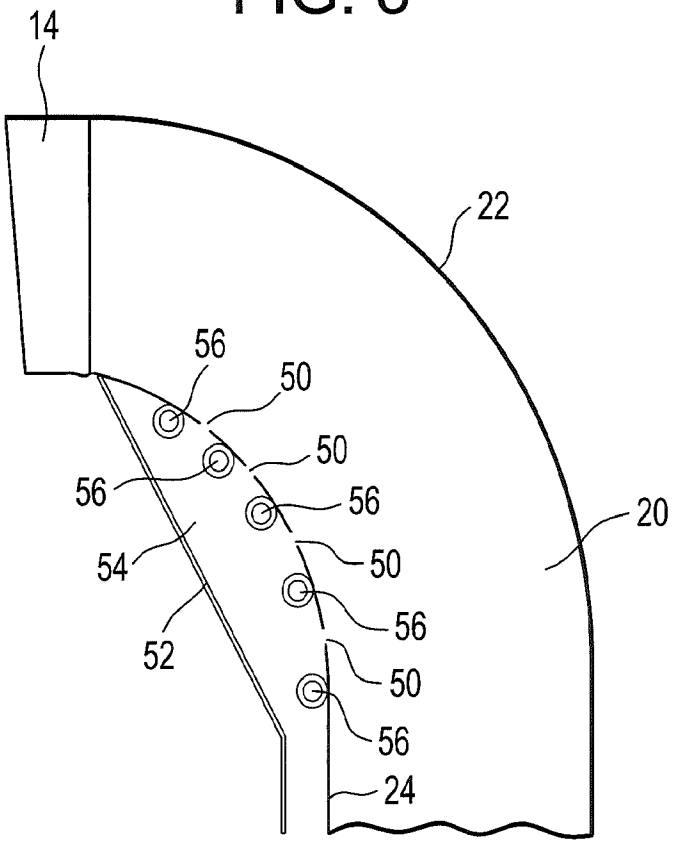
FIG. 3 is a cross section of a portion of the steam turbine of FIGS. 1 and 2 having a hollow steam guide diffuser according to an embodiment of the present invention.

In FIG. 3 is an embodiment of the present invention that illustrates the last turbine stage blade 14 followed by the diffuser 20 in the turbine portion 12 of FIG. 1. The bearing cone 22 may be similar to that shown in FIGS. 1 and 2. However, the steam guide 24 has at least one hole 50, and as shown in FIG. 3 a plurality of holes 50, located therein. A solid plate 52 is located behind or below the steam guide 24, as viewed in FIG. 3. As such, an opening 54 is located in between the steam guide 24 and the solid plate 52. With the addition of the solid plate 52 in the embodiment of FIG. 3, the steam guide 24 may be considered to be a "hollow" steam guide. Also, a water tube or pipe 56, shown in cross section in FIG. 3, is located in the opening 54 in the hollow steam guide. The water tube 56 may be located in the opening 54 in a circumferential manner. The water tube 56 creates a condensation of the steam flowing in the diffuser 20.

The embodiment of FIG. 3 with respect to a down flow type of diffuser is similarly applicable in all aspects to an axial type diffuser in which the flow of steam downstream in the diffuser is not directed from an axial direction to a radial direction towards a condenser or an exhaust hood. Instead, the flow of steam continues to flow axially downstream into a condenser. Otherwise, the axial diffuser is similar to the down flow diffuser as described above. In the embodiment of an axial diffuser, the solid plate is located around a steam guide to create the hollow opening.

Figure 4:
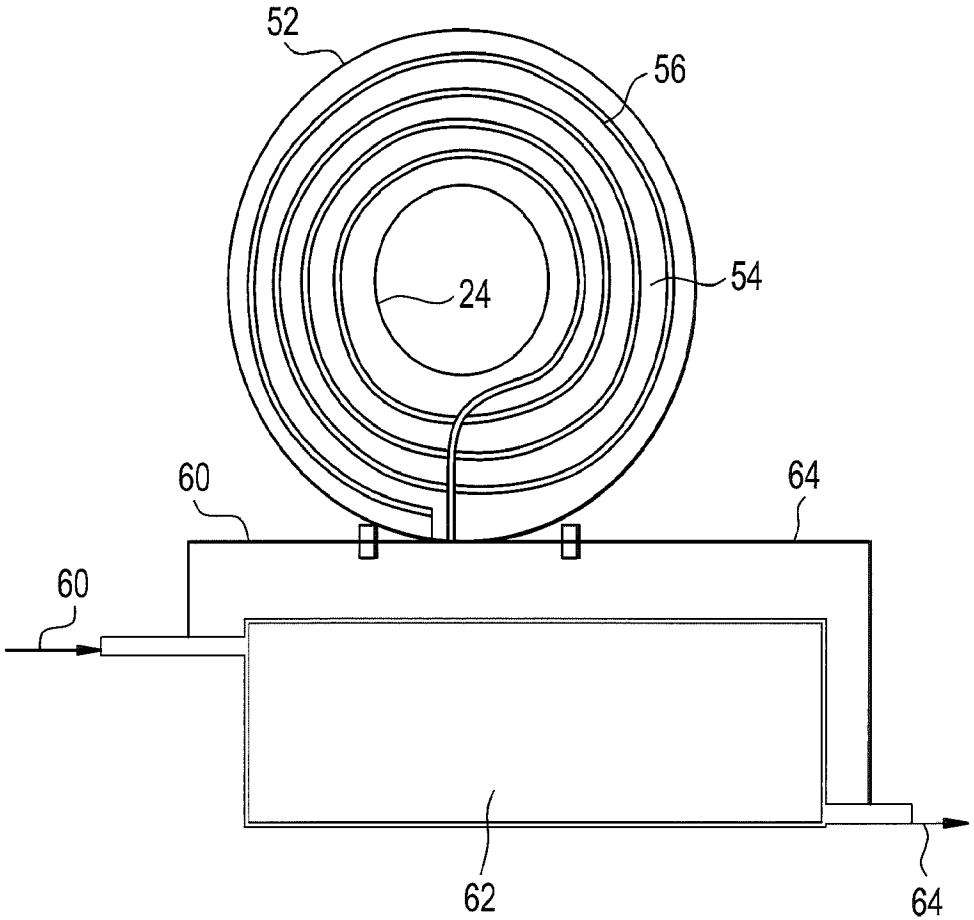
FIG. 4 is a schematic of the hollow steam guide diffuser of FIG. 3 connected with a condenser portion of the steam turbine of FIGS. 1 and 2 according to an embodiment of the present invention.

In FIG. 4 the embodiment of FIG. 3 is shown in more detail. The water tube 56 is shown coiled within the opening 54 in the hollow steam guide. The water tube 56 may be fed by relatively cold water (with respect to the steam) in a pipe 60 supplied from any number of locations in the steam turbine plant 10. The cold water in the pipe 60 may also enter a condenser 62 of the steam turbine 10. The cold water flows through the water tube 56 and exits the tube 56 in a pipe 64 and joins with the relatively hot water output from the condenser 62.

In the embodiment of the present invention shown in FIGS. 3 and 4, the water tube 56 carrying the relatively cold water condenses the steam flowing in the diffuser 20, 28 in the vicinity of the inner surface of the steam guide 24, 32. The condensation creates at least a partial vacuum, such as a low pressure vacuum within the hollow opening 54. Once the vacuum is created using the water condensation, the flow of steam 26 in the diffuser 20, 28 experiences a suction effect due to the holes 50 in the steam guide 24, 32. As a result of the suction effect, the flow of steam 26 in the diffuser 20, 28 tends to attach itself to the inner surface of the steam guide 24, 32 and does not separate itself therefrom. Thus, the flow of steam 26 utilizes the entire area ratio. This results in an increase in static pressure recovery in the diffuser 20, 28 of the steam turbine 10, which, in turn, increases the heat rate or output of the steam turbine 10.

Embodiments of the invention provide for the flow of steam through the diffuser 20, 28 in which the flow 26 does not separate from the steam guide 24, 32 at relatively high area ratios. This improves the pressure recovery in the diffuser 20, 28.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A steam turbine, comprising:

a diffuser that comprises a bearing cone and an inner plate of a steam guide that define a passage through which steam flows;

an outer plate disposed with respect to the inner plate such that an opening is located between the inner and outer plates;

at least one hole in the inner plate; and a water tube comprising a single, continuous coiled pipe circumferentially extending around the outer plate and disposed in the opening, the water tube having water flowing therethrough which condenses at least a portion of a flow of steam flowing in the passage thereby creating at least a partial vacuum within the opening, the vacuum creating a suction effect through the at least one hole in the inner plate that can cause at least a portion of the flow of steam in the passage to attach itself to an inner surface of the inner plate.

2. The steam turbine of claim 1, further comprising a low pressure turbine section from which the flow of steam passes into the diffuser.

3. The steam turbine of claim 1, the inner plate of the steam guide comprises a plurality of holes located therein, the vacuum creating a suction effect through at least some of the plurality of holes in the inner plate that causes at least a portion of the flow of steam flowing through the passage to attach itself to an inner surface of the inner plate.

4. The steam turbine of claim 1, the diffuser directs the flow of steam from an axial direction to a radial direction with respect to an axis of the steam turbine.

5. The steam turbine of claim 1, water flowing through the water tube comprises water provided to a condenser of the steam turbine.

6. The steam turbine of claim 1, the passage in the diffuser comprises an annular passage.

7. The steam turbine of claim 1, the flow of steam passes through the diffuser and into an exhaust hood of the steam turbine.

8. An axial diffuser for a steam turbine, the axial diffuser comprising:

a bearing cone and an inner plate of a steam guide that define a passage through which steam flows downstream therethrough;

an outer plate disposed with respect to the inner plate such that an opening is located between the inner and outer plates;

at least one hole in the inner plate; and a water tube comprising a single, continuous coiled pipe circumferentially extending around the outer plate and disposed in the opening, the water tube having water flowing therethrough which condenses at least a portion of a flow of steam flowing in the passage thereby creating at least a partial vacuum within the opening, the vacuum creating a suction effect through the at least one hole in the inner plate that can cause at least a portion of the flow of steam in the passage to attach itself to an inner surface of the inner plate.

9. The axial diffuser of claim 8, further comprising a low pressure turbine section from which the flow of steam passes into the axial diffuser.

10. The axial diffuser of claim 8, the axial diffuser directs the flow of steam downstream into a condenser.

11. The axial diffuser of claim 8, water flowing through the water tube comprises water provided to a condenser.

12. The axial diffuser of claim 8, water flowing through the water tube exits the water tube and connects with water flowing out of a condenser.

13. The axial diffuser of claim 8, the passage in the axial diffuser comprises an annular passage.

14. A diffuser section of a steam turbine, the diffuser section comprising:

a bearing cone;

a steam guide having an inner plate, the bearing cone and the inner plate of the steam guide defining a passage through which steam flows;

an outer plate disposed with respect to the inner plate such that an opening is located between the inner and outer plates;

at least one hole in the inner plate; and a water tube comprising a single, continuous coiled pipe circumferentially extending around the outer plate and disposed in the opening, the water tube having water flowing therethrough which condenses at least a portion a flow of steam flowing in the passage thereby creating at least a partial vacuum within the opening, the vacuum creating a suction effect through the at least one hole in the inner plate that can cause at least a portion of the flow of steam in the passage to attach itself to an inner surface of the inner plate.

15. The diffuser section of claim 14, the diffuser directs the flow of steam from an axial direction to a radial direction with respect to an axis of the steam turbine.

16. The diffuser section of claim 14, the inner plate of the steam guide comprises a plurality of holes located therein, the vacuum creating a suction effect through at least some of the plurality of holes in the inner plate that can cause at least a portion of the flow of steam flowing through the passage to attach itself to an inner surface of the inner plate.

17. The diffuser section of claim 14, water flowing through the water tube comprises water provided to a condenser of the steam turbine.

18. The diffuser section of claim 14, the passage in the diffuser comprises an annular passage.

* * * * *